US005424703A

United States Patent [19]

Blume, Jr.

[11] Patent Number: 5,424,703

[45] Date of Patent: Jun. 13, 1995

[54] MAGNETIZATION OF PERMANENT MAGNET STRIP MATERIALS

[75] Inventor: Walter S. Blume, Jr., Ocala, Fla.

[73] Assignee: The Electrodyne Company, Inc., Batavia, Ohio

[21] Appl. No.: 880,548

[22] Filed: May 8, 1992

[51] Int. Cl.[6] ..... H01F 7/20; H01F 13/00

[52] U.S. Cl. ..... 335/284

[58] Field of Search ..... 335/284, 298, 306, 285–288, 335/295–297, 302; 310/90.5; 361/143, 147, 149, 151; 210/222, 223; 209/38–40, 212–232, 478

[56] References Cited

U.S. PATENT DOCUMENTS

| | | | |
|---|---|---|---|
| 2,187,240 | 1/1940 | Karasick . | |
| 3,127,544 | 3/1964 | Blume, Jr. . | |
| 4,379,276 | 4/1983 | Bouchara et al. . | |
| 4,800,353 | 1/1989 | Csonka | 335/284 |
| 4,829,276 | 5/1989 | Leupold . | |
| 4,946,590 | 8/1990 | Hertzog | 210/222 |
| 4,999,106 | 3/1991 | Schindler | 210/222 |
| 5,107,238 | 4/1992 | Leupold | 335/306 |
| 5,160,877 | 11/1992 | Fujiwara | 310/90.5 |

FOREIGN PATENT DOCUMENTS

| | | | |
|---|---|---|---|
| 0192307 | 9/1985 | Japan | 335/284 |
| 0062010 | 3/1990 | Japan | 335/284 |
| 416806 | 1/1967 | Switzerland | 335/284 |

OTHER PUBLICATIONS

R. Bozworth, Ferromagnetism, "Materials For ¼er, amemt Magnets", D. van Norstrand, 1951, pp. 360–362.

*Primary Examiner*—Gerald P. Tolin
*Assistant Examiner*—R. Barrera
*Attorney, Agent, or Firm*—Wood, Herron & Evans

[57] ABSTRACT

Disclosed is an apparatus and process for magnetizing permanently magnetizable strip and sheet material to form a pattern of band-like poles on the material. Two parallel stacks of permanent magnets are used, each magnet in each stack having a direction of magnetization which is perpendicular to a slot-like air gap between the stacks. The magnets in each stack are parallel to one another, with unlike poles of adjoining magnets proximate so that they mutually attract one another. Unlike poles of the respective magnets in opposite stacks are positioned diametrically opposite each other across the air gap. The apparatus does not use electromagnetic coils and can form very narrow, contiguous band-like poles on magnetizable sheet or strip material which is passed through the air gap.

41 Claims, 4 Drawing Sheets

MAGNETIZATION OF PERMANENT MAGNET STRIP MATERIALS

FIELD OF THE INVENTION

This invention relates to the magnetization of permanent magnet materials.

BACKGROUND

Conventional magnetization produces only two poles at opposite ends of a magnet, one north and the other south. For many types of permanent magnet materials it is most commonly carried out by use of an electromagnet. The electromagnet simply comprises an iron yoke with high permeability pole pieces and coils wound about either the yoke or the pole pieces between which the material to be magnetized is positioned. A direct electric current is passed through the coils to create a magnetizing field. The magnetizing field strength varies (though non-linearly) with the amplitude of the current, if all other factors remain the same.

The magnetization of modern materials which require unusually strong magnetizing fields, such as samarium cobalt and the neodymium iron class of rare earth permanent magnets, frequently requires the use of an "impulse" type magnetizer. Impulse magnetizers are also widely used where complex pole patterns (such as band-like or "multiple" poles) are needed. A special power supply is an essential part of the impulse magnetizer; it must accomplish more than merely rectify AC to DC current. For band-like poles, special magnetizing fixtures are often used, with windings shaped like a potato masher of relatively short overall wire length. The number of turns of wire and wire sizes that can be employed in such devices are limited by the need to accommodate the current required to produce the needed magnetizing field. High currents are required for the conventional magnetization of older magnetic materials (e.g., barium ferrite) when the magnets are large and/or require a saturation field ($H_s$) in excess of about 5000 oersteds. Extremely high currents, to produce fields up to about 45,000 oersteds, are required to saturate magnets of the rare earth type as well as to form complex multiple pole patterns, even for older materials. At present, the especially high currents needed to produce multiple poles in very narrow band-like patterns can only be developed by the sudden discharge of a large capacitor into the turns of a properly designed coil. The impulse magnetizer comprising the power supply and the fixture containing the magnetizing coil into which the current is suddenly discharged, creates a strong but transient field which lasts only for a period of a few milliseconds.

It is frequently desirable to magnetize barium, strontium and/or lead ferrite strip and sheet-like materials so that they have multiple poles, that is, poles which are in the form of parallel, alternating N-S bands on one or both faces of the material. Where holding force is the primary objective, such poles should touch at their boundaries, and the thinner the sheet or strip being magnetized the narrower the poles should be. The more fully these conditions are met, and the more fully the material is magnetized, the more strongly the resulting magnet will hold an object which is facially engaged with it. (However, the "reach" or trajectory of the flux lines in the region around the strip diminishes with narrowing of the poles.) As a practical matter, where band-like poles are to be formed with an impulse magnetizer, the area and depth to which a strip or sheet can be magnetized is restricted by the current required (and thus by the size and total length of wire which may be used), as well as by the total number of poles to be formed concurrently per unit width of the strip by each discharge of the magnetizer. For example, if an exceptionally good impulse magnetizer is used to form about 18 poles per inch (of width) on 0.030" thick commercial barium ferrite composite, only a volume of about 0.25 to 0.75 cubic inches of material can be effectively magnetized by each discharge of the impulse magnetizer. Because of the limited volume of material which can be magnetized with a single discharge, in order to magnetize a long strip the capacitor must be recharged after each discharge, the strip indexed or advanced, the capacitor again discharged, the strip again indexed, and so on repetitively. This, of course, substantially slows the process of multiple pole magnetization. Moreover, impulse magnetizers are noisy (the discharge creates a sudden crack or report); further, they overheat, fail dielectrically, break down, represent potential electrical hazards, and are quite expensive to build or purchase.

THE PRIOR ART

My previous U.S. Pat. No. 3,127,554 discloses a non-impulse type electromagnetic magnetizing apparatus for forming band-like poles. That apparatus comprises two spaced electromagnetic coil assemblies, each assembly having a north and south primary pole piece with a plurality of ferromagnetic secondary pole pieces between the primary pole pieces of each assembly. Non-magnetic spacers are placed between the secondary pole pieces. Each spacer of an assembly is substantially centered diametrically opposite the midpoint of a secondary pole piece of the opposite assembly. That apparatus is not an impulse magnetizer and does not require step-wise advancement of material through it; it can magnetize strip material continuously. However, it does require electromagnetic coils to create the field.

Bouchara et al. U.S. Pat. No. 4,379,276 shows a magnetizer which, rather than using electromagnetic means, utilizes permanent magnets to generate the magnetizing field. That apparatus uses two opposite stacks, each comprising plate-like permanent magnets which must be separated by high permeability (ferromagnetic) pole pieces. Each magnet is magnetized in the direction perpendicular to its plate faces, i.e., parallel to the axis of the stack and parallel to the gap between the stacks. The magnets in each stack are arranged with like poles on opposite sides of each pole piece. The high permeability pole pieces act as conduits to conduct the flux away from the magnets and outwardly to the edges of the pole pieces and to the gap between which the strip material is passed. That apparatus does not require electrical current for operation, but because it requires the pole pieces between the permanent magnets, the polar bands which the pole pieces form on the magnetic material are necessarily spaced apart by an unmagnetized or "neutral zone" between them. The neutral zones between adjacent poles waste a large proportion of the material used. Since holding power of the magnetized strip decreases with the distance between the poles imparted to it, as well as with incomplete magnetization of the body of the strip, the resulting magnets will have less than half the holding power they could have if the poles adjoined one another.

There has been a need for an apparatus for permanent (hard) magnetization of strip and sheet material which can provide narrow, contiguous poles, with virtually no unmagnetized zone between them, which does not require energization by an outside source of power, and through which material can be moved continuously at a high rate of speed without having to magnetize it step-by-step in sequential localized sections.

SUMMARY OF THE INVENTION

The apparatus of this invention utilizes permanent magnets as the magnetizing source; no coils or electromagnets are required, and it forms band-like poles on strip and sheet material virtually as quickly as the material can be passed through it, that is, no step-by-step indexing is required.

The apparatus comprises two parallel spaced apart stacks of permanent magnets with an air gap between them, wherein each magnet is magnetized in a direction that is mutually perpendicular to the axes of the stacks. The magnets can be in the form of disks, plates, cylinders, prisms, bars and other shapes, provided they meet the criteria as to direction of magnetization. By way of specific example, the magnets can be in the form of thin circular plates having two parallel faces. The diameter of the faces presents the plate-like magnet's longest axis, and the direction of magnetization is parallel to the faces. The perimeter or circular edge rimming each plate-like magnet is at right angles to each face. Each magnet has a north pole and a south pole, located at diametrically opposite positions on the perimeter. The magnets in each stack are parallel to one another with their adjacent unlike poles adjoining so that the magnets strongly attract each other magnetically and are magnetically coupled. The plate-like magnets are stacked face to face to form a right cylindrical stack. The two stacks are held spaced apart from one another to form a slot-like air gap between them, which is the magnetizing space through which strip or sheet-form permanent magnet materials are passed to be magnetized. The directions of magnetization of the magnets in both stacks are perpendicular to the gap, and the poles of magnets in one stack are diametrically opposite unlike poles of the magnets in the other stack. Thus, not only do the magnets in each stack attract one another, the opposing stacks also attract one another. The stacks are housed in non-magnetic holders or housings which are in turn mounted in a frame that holds the stacks spaced apart in the precise alignment required of them. The frame need not be magnetic and does not concentrate or redirect the flux. For magnetizing bonded barium, strontium, or lead ferrite materials, it is presently sufficient and preferred that the magnetizer magnets be of the samarium cobalt variety. However, still more powerful magnet materials are being developed in the industry, and their use for the magnetizing magnets is also contemplated. Magnets of the neodymium iron class are also suitable for practicing the invention.

DESCRIPTION OF THE DRAWINGS

The invention can best be further described by reference to the accompanying drawings, in which:

FIG. 12A shows a stack (row) of square sectioned elongated bars, in side-by-side coplanar contact;

DETAILED DESCRIPTION

Figure 2:
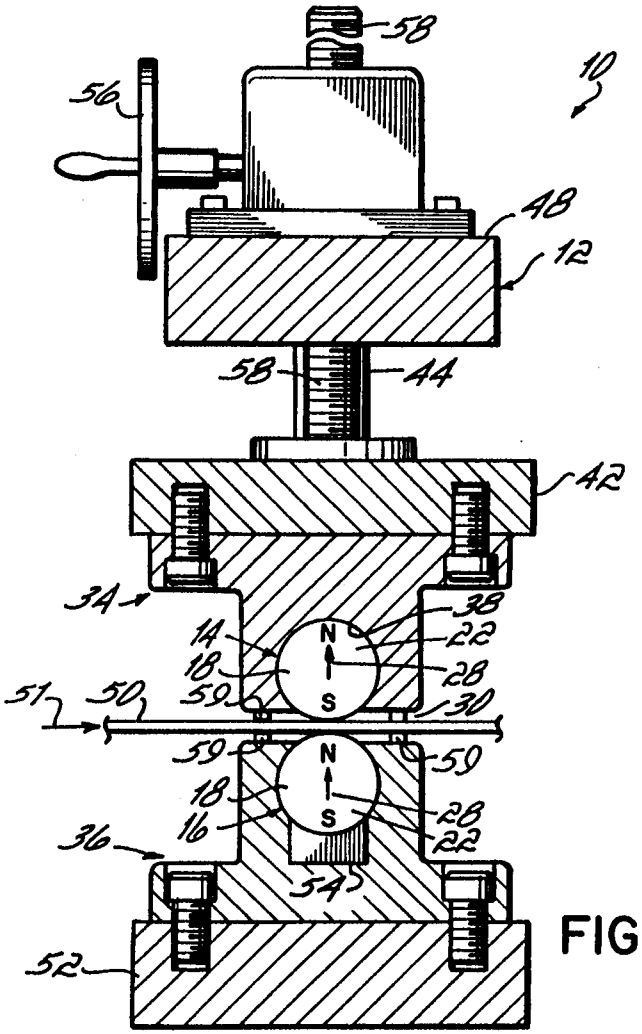
FIG. 2 is a vertical cross section taken on line 2—2 of FIG. 1.
Figure 1:
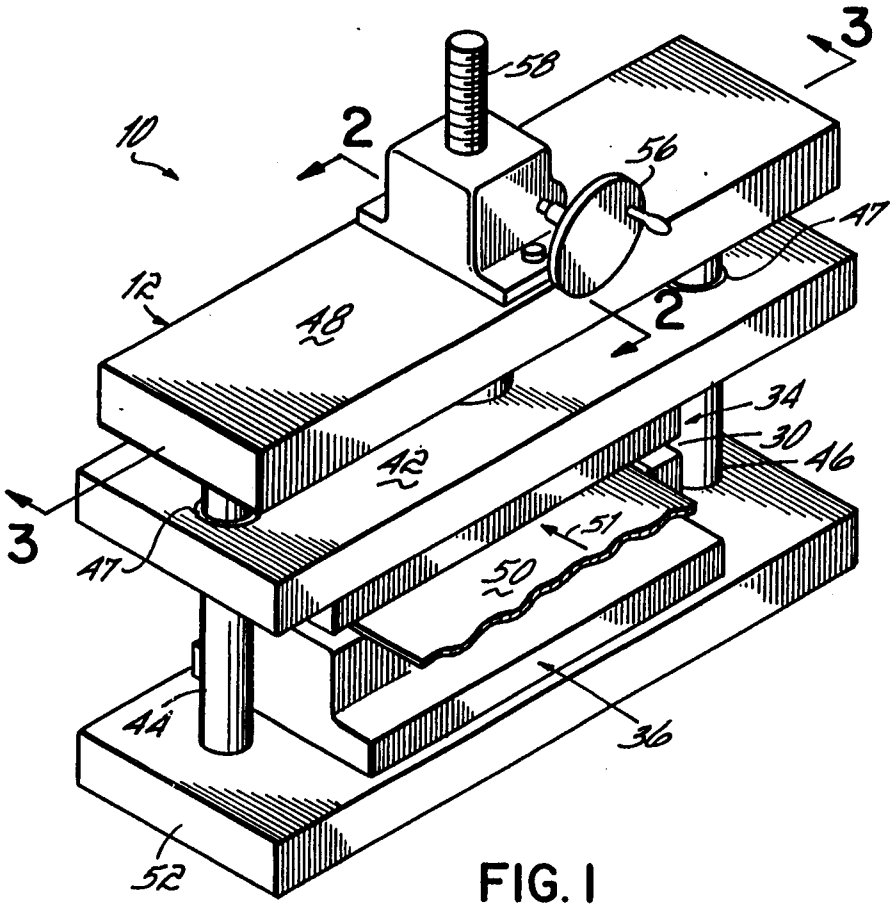
FIG. 1 is a perspective view of a preferred form of magnetizer in accordance with the invention, showing strip material being fed through it for magnetization.
Figures 3, 4:
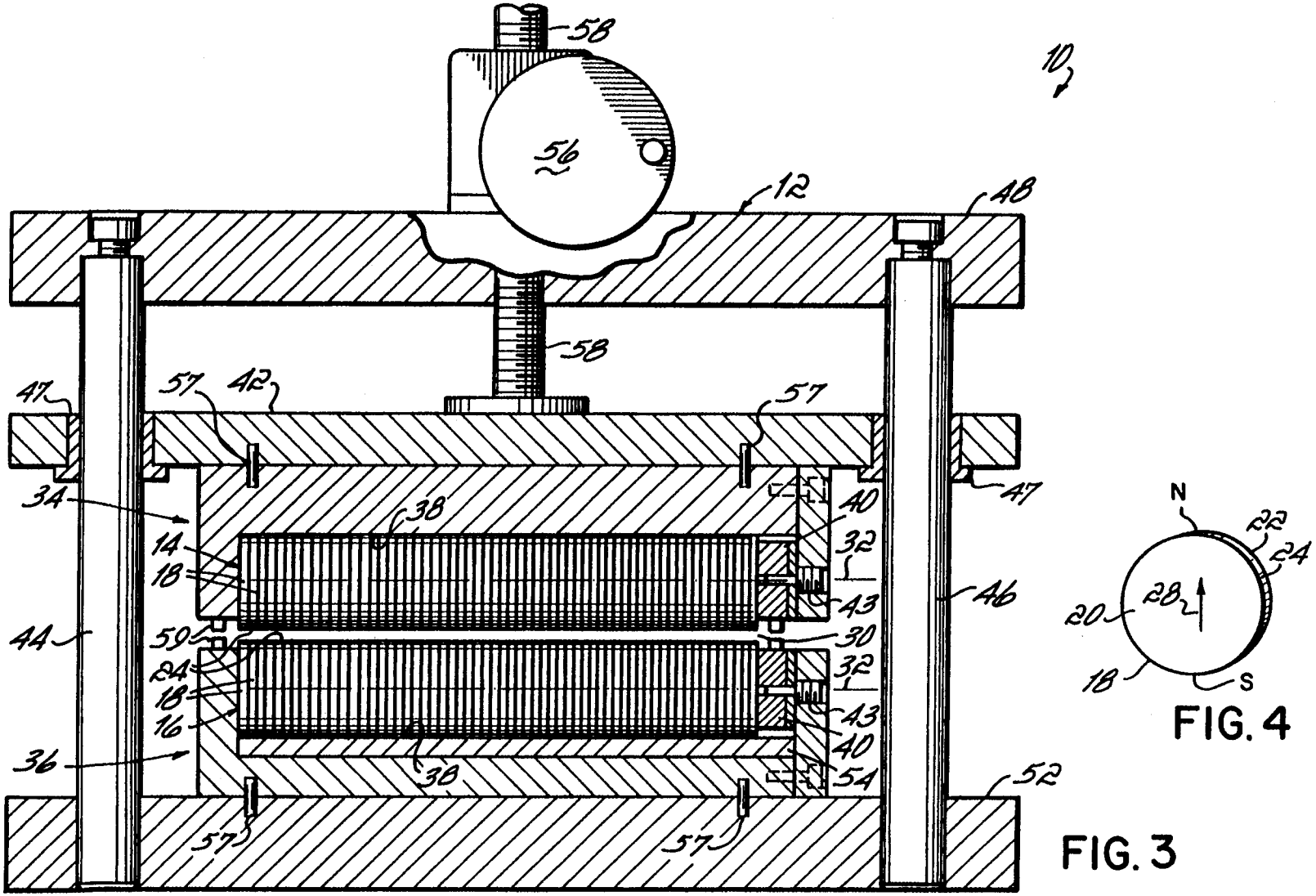
FIG. 3 is a vertical longitudinal section taken on line 3—3 of FIG. 1.
FIG. 4 is a perspective view of an individual circular plate-like magnet of the apparatus.
Figure 5:
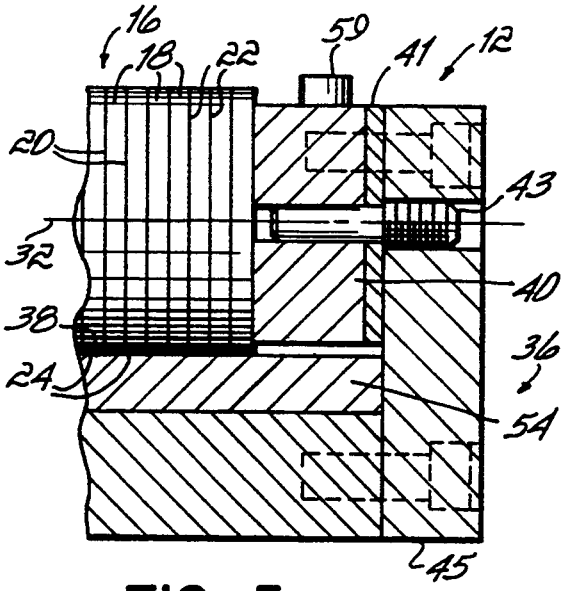
FIG. 5 is an enlarged fragmentary section of an end portion of one of the stacks of magnets in its housing.

As best shown in FIGS. 1–3, the preferred form of magnetizer apparatus 10 of the invention includes a frame 12 which supports and positions two magnet holders 34 and 36 which in turn house stacks 14 and 16 of individual permanent magnets each designated by 18. In this embodiment each magnet 18 is preferably in the shape of a plate or disk, as shown in FIG. 4, that is, thin with flat parallel major faces 20 and 22. The magnets 18 of this embodiment have a circular outline. (As discussed below, other shapes may be used, e.g., plates of other perimeters, including rectangular, square, oval, and so on; or the magnets may have the form of elongated cylinders, including prisms, bars, etc. of an almost unending variety of cross-sectional shapes.) Each magnet 18 has a circular perimeter or edge 24 between its faces 20, 22 and thus is in the form of a thin circular disk (FIG. 4). The magnets 18 in a given stack 14, 16 are desirably all of the same size and shape, as shown in FIGS. 3 and 5. Both stacks 14, 16 are long enough in the axial direction and comprise sufficient magnets to accommodate, with a margin of safety, the width of the strip or sheet to be magnetized.

Each magnet 18 has a direction of magnetization which is perpendicular (normal) to the air gap 30 developed between the stacks 14, 16 (FIG. 2) and which is parallel to the faces 20 and 22 of the magnet. The direction of magnetization is parallel to the longest axis of the magnet, which in this embodiment is its diameter. This is not the usual direction of magnetization for materials having a demagnetization curve with a slope approaching unity, as many grades of samarium cobalt magnets do; it is in fact perpendicular to the usual direction. For use herein, each magnet 18 has its poles on the edge 24 (the peripheral surface between the faces 20,22), a north pole on one end and a south pole on the diametrically opposite end, as indicated by N and S in FIGS. 2, 4 and 7. The magnetic length of each magnet is the distance measured between its poles in the direction of magnetization 28 which, for a circular plate-like magnet 18, is equal to its diameter. The direction of magnetization is perpendicular to the shortest dimension of the magnet (its thickness). Magnet length is selected to provide the degree of magnetization needed for the particular material to be magnetized. While parameters other than length affect performance, attention to length leads to the maximum performance possible in relation to the influence of the parameters present. If magnetic length is extended beyond the point of establishing optimum performance, it will not detract from it even though increasing length also adds to leakage. The most practical rule for establishing such performance is to increase magnetic length freely to a point beyond which subsequent increase in strength of the magnetizing field (produced by the magnet) becomes negligable. Again, free extension of magnetic length to optimize performance is sharply contrary to the usual practice for permanent magnet materials having a demagnetization curve with a slope approaching unity.

While spacers may be used between adjacent magnets in each stack, it is not as advantageous to do so. The magnets in the stack are preferably positioned as close as possible, touching one another in face or line contact. The thickness of each magnet (the dimension between its opposite faces 20, 22) determines and equals the width of the band-like poles which the apparatus will form on the material being magnetized. Spacers space the band-like poles farther apart, causing the holding power of the magnetized strip to be less than it would be if the spacers were not present.

For efficient use, the magnetic length of a samarium cobalt magnet is customarily developed parallel to its short dimension (thickness); by contrast, in this apparatus they are magnetized in a direction perpendicular to the short dimension. The sum total magnetic length of each pair of opposite magnets 18, 18 presenting gap 30 of the apparatus must be sufficient to provide the desired degree of magnetization of the strip or sheet. To encompass the many magnet parameters which can vary, the sum total magnetic length is preferably about 6 to 100 times the height of gap 30. (The preferred range of magnetic lengths for the individual magnets is therefore half this range, that is, about 3–50 times gap height.) The gap height, practically speaking, is equal to the thickness of the material to be magnetized in it (FIG. 1). For example, to magnetize a superior grade of commercial bonded barium ferrite material about 0.030" thick with 18 poles to the inch of width and capable of producing an attractive force on contact of 20 ounces per square inch, samarium cobalt magnets 0.055" thick and having a magnetic length (diameter) of 1.5" can be used. This represents a sum total length for each pair of opposed magnets which is 100 times the thickness of the barium ferrite material to be magnetized. However, depending upon the specific parameters of the apparatus, relatively smaller magnetic lengths in relation to a given strip thickness can also produce excellent results in respect to the material to be magnetized. In practice, the optimum magnet length/strip thickness ratio depends upon numerous variables, including the quality and grade of the material to be magnetized, its thickness, its anisotropy (if any), multiple pole width, and other factors. The ratio is further dependent on the quality or grade of samarium cobalt or other magnets selected as the means of accomplishing the magnetization intended, the second quadrant permeability of the magnet, the air gap height in relation to magnet thickness and other user-elected variables.

In order to maintain flux circuit balance, all the magnets 18 preferably have the same length. Thus the total sum of the magnetic lengths of corresponding magnets on opposite sides of the air gap should be twice the length of each individually.

Figure 7:
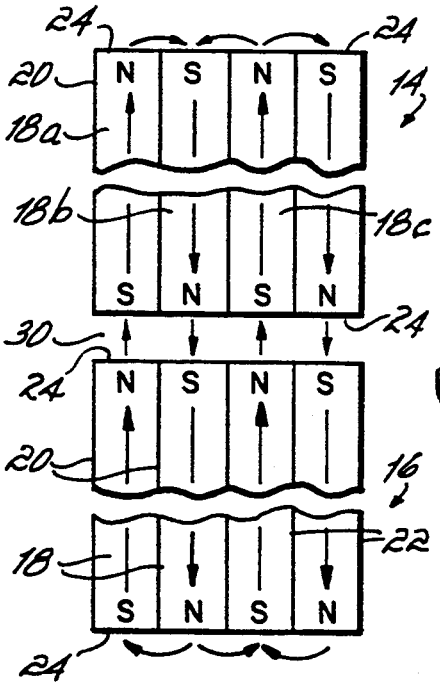
FIG. 7 is a diagrammatic view showing the flux circuit (other than leakage) in two parallel magnet stacks positioned in accordance with the invention.

Sequential magnets 18 in each stack have their poles positioned alternately; that is, the north pole of one magnet 18*a* is at the top edge of its perimeter and is adjacent to the south pole of the next magnet 18*b* in that stack, which is in turn adjacent the north pole of the next magnet 18*c* (FIG. 7). Thus the adjacent magnets 18 in a given stack attract one another. The plates are placed in facial engagement with one another with no spacer of any type (magnetic or non-magnetic) between them.

Figure 6:
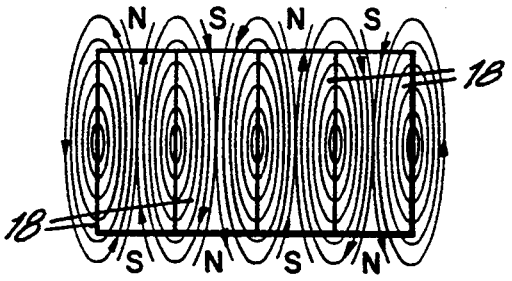
FIG. 6 is a diagrammatic view showing the flux pattern of a single, isolated stack of magnets.

Because each plate-like magnet preferably facially engages an adjacent magnet in the stack, it would be expected that each pair of magnets 18 would "short circuit" one another and would manifest little useful external flux, as indicated diagrammatically in FIG. 6. Most of the lines of flux from one magnet in the stack would be predicted to pass directly into the next magnet as shown, without passing into the space outside the stack (into the gap) in any degree sufficient to effectively magnetize modern day magnet materials. Surprisingly, however, that is not the case in respect to the invention.

The axes 32, 32 of the two stacks 14 and 16 of magnets are parallel to one another. The direction of magnetization of the magnets, indicated by vectors 28, 28, is mutually perpendicular to the axes 32, 32 of the stacks; that is, the direction lies within the plane defined by the two axes and, within that plane, it is perpendicular to the stack axes. Thus the direction of magnetization of the magnets in the stack is perpendicular to the plane of the strip or sheet to be magnetized. The slot-like air gap between the stacks is presented between the perimeters 24, 24 (FIG. 3) of the stacks, where the stacks are closest. The material 50 to be magnetized is passed through air gap 30, in a direction perpendicular to the direction of magnetization 28 of the magnets.

The two stacks 14, 16 are mounted in non-magnetic holders or housings 34, 36 preferably of aluminum, which are positioned by the frame 12 so that their central axes 32, 32 are parallel, and the planes of the faces 22, 22 of the corresponding magnets of the two stacks are also coplanar (FIG. 3). Pragmatically, no magnet or magnets of a stack should extend into the gap beyond any other magnet in the stack, that is, the gap height should be essentially constant. The stacks are positioned so that unlike poles are directly opposite each other across the gap, that is, the south pole of magnet 18*a* in the upper stack 14 is adjacent the north pole of the corresponding magnet of the opposite stack 16, and so on (FIG. 7).

Figure 8:
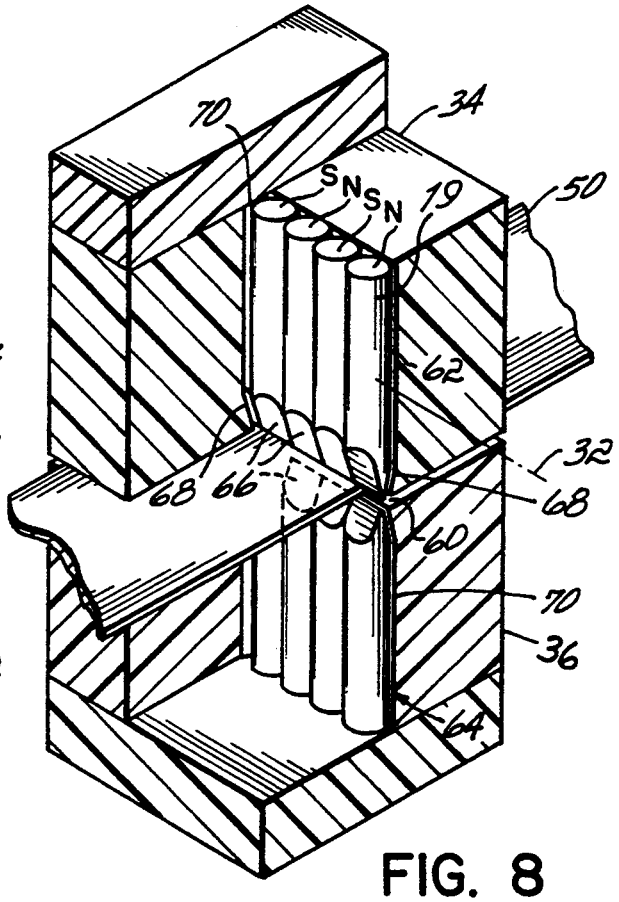
FIG. 8 is a diagrammatic cut-away perspective view of two stacks of elongated bar magnets in their housings, in accordance with another form of the invention.
Figure 9:
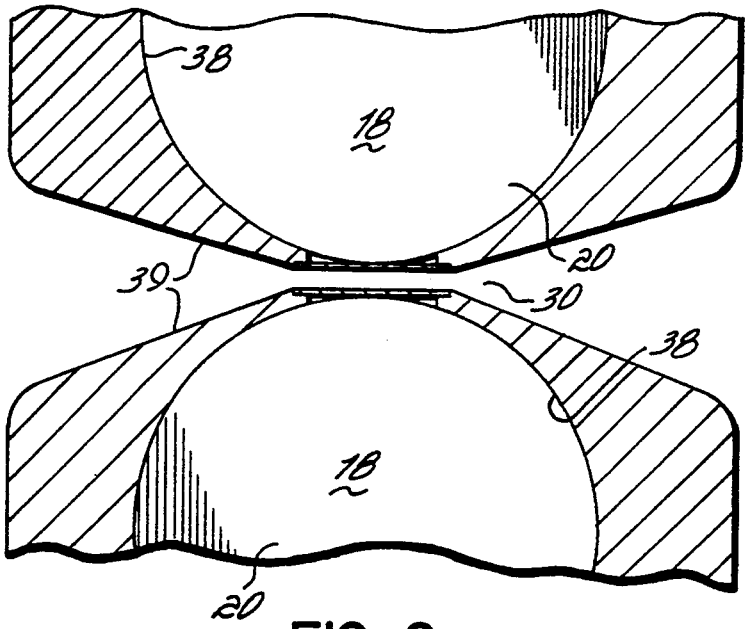
FIG. 9 is an enlarged fragmentary cross-section of fully housed stacks of magnets, in accordance with a modified form of the invention.

Apart from the non-magnetic housings 34, 36, the materials for the members of frame 12 which are structural and non-magnetic in function, are a matter of choice appropriate for the purpose of each, for example machine steel for the base 52 and posts 44, 46, bronze for the bearings 47 and aluminum for the plates 42, 48. The frame 12 includes interchangeable upper and lower magnet housings 34, 36, each having a cavity or bore 38 sized to receive a stack. (In the embodiment of FIGS. 1–5, bore 38 has a circular cross-section, in order to receive the cylindrical stacked plate-like magnets. Bar magnets, if used, are received in a slot-like cavity, as shown in FIG. 8.) The bores 38 may conveniently have identical, diametrically opposed, longitudinal openings extending from their circumference which expose a chordal portion of each stack. Each longitudinal opening faces that of the opposite stack and a chordal portion of each stack projects outwardly beyond the face of its holder to the space defining gap 30 (see FIG. 2). It may be noted, however, that the magnets need not necessarily extend outwardly beyond the holder to the exterior. A near paper-thin non-magnetic web (such as non-magnetic stainless steel) may either be affixed to (see FIG. 9) or machined tangentially toward the portion of the cavity or bore from which the stacks would otherwise extend. This affixed or machined surface may be plated with hard chrome. The web covers and protects the stacks from collecting magnetic debris; a hard chrome plating presents a low coefficient of friction in relation to the passage of material being magnetized and thus lessens any wear of the protective covering provided for the stacks. The axial length of each bore 38 is greater than the stacked length of the magnets housed in it, and the stack is secured axially in the bore via a metal washer 41 which bears against an intermediate cushion 40. The cushion is preferably an elastomeric material of the type commonly used in heavy duty forming applications, as in metal drawing dies and the like. The cushion is caused to bear against the end of the magnet stack by tightening of screw 43 threaded in an end cap 45 of the holder 36 (FIG. 5). Since samarium cobalt magnets and other rare earth magnets are extremely brittle, care must be taken to assure that they are not subjected to localized pressure which could cause them to crack or chip under pressure in the holder. Cushion 40, though compressible, will hold the stacked magnets securely in place without exerting undue pressure, e.g., should screw 43 be tightened more than would otherwise be safe. The screw 43 may be concealed or covered (as by epoxy) to prevent tampering or removal of the magnet stacks from their holders.

An elongated high permeability ferromagnetic shunt may be used, opposite the poles presenting the air gap, to connect the outboard poles of one or both stacks. One such shunt 54 is illustrated in FIG. 2, in the lower holder 36. Shunts are not presently preferred (they introduce tolerance, assembly and disassembly problems, and are mechanically encumbering to the holder as well), however, a shunt for each stack can, depending upon the perameters present, reduce the preferred magnetic length range separately in respect to the individual stack, from a range of about 3 to 50 times gap height to a range of about 3 to 25 times gap height.

Upper holder 34 is secured to a non-magnetic slide plate 42, which is guided for movement along vertical guide posts 44, 46. Frame 12 also includes a fixed top plate 48 and base 52. The upper holder 34 is removably affixed, as by screws and locating pins, to slide plate 42 (FIG. 2), and lower holder 36 is removably affixed to base 52. Both holders are removable so that different holders can be installed in matched pairs having magnets suitable to produce different pole spacing and to magnetize other widths and thicknesses of strips. Aligning pins 57 (FIG. 3) are used to establish and maintain precise alignment of the stacks relative to one another.

The effectiveness of this magnetizer is surprising, and flies in the face of conventional magnet design theory. Conventional theory suggests that an insufficient amount of flux would extend in the air gap developed between the magnet stacks. The art teaches that permanent magnets, even as applied in an optimal design, may lose up to 90% or more of the total available flux by leakage without reaching the poles. Leakage flux losses have consistently been a thorn in the side of those who use permanent magnets. R. Bozorth, in his treatise *Ferromagnetism,* D. Van Nostrand, 1951, p. 360–362, indicates that even in an optimal design, the useful flux in a working gap between the poles of a magnet is only a small percentage of the sum total flux generated by the magnet he describes in the text (only 7% of the total flux was available for the particular example there given, with 93% lost to leakage). The flux loss in a given situation depends upon the demands of the application, efficiency of use, and other factors. Such high leakage stems from the fact that there is no insulation against leakage: magnetic flux simply flows along the path of least reluctance, whatever the substance surrounding the magnet. FIG. 6 diagrammatically shows the large amount of leakage flux developed by a single stack of magnets, according to conventional theory, experience and measurement. Because of such leakage an inordinately small proportion of total flux passes through the diametrically opposed poles established by magnetization of the magnet. From this it would be expected that it would be impractical, indeed virtually impossible, to form highly magnetized, narrow, band-like poles on a material such as barium ferrite with one or two such stacks: most of the flux would be expected to leak directly from the side of one magnet into the side of the next along the stack without passing outwardly to any significant degree beyond the poles specifically established by their magnetization.

Nevertheless, I have found that a very strong field can be created in the gap, sufficient even to magnetize barium ferrite strip and other materials to a degree and in a pattern heretofore accomplished only with the use of an impulse type magnetizer.

FIG. 7 diagrammatically shows the circuit taken by flux developed in the working gap between the stacks, without illustrating the leakage. The path extends from the north pole of a magnet in one stack, across the gap to the south pole of the opposite magnet of the other stack, and from that magnet to the north pole of the next magnet of its stack, then across the gap again, and so on. (Non-magnetic spacers would diminish leakage losses between adjacent magnets to a small degree, to no advantage. The non-magnetized neutral zones created by spacing the magnets farther apart would have an overriding affect insofar as they would result in a significant net decrease of the force of attraction, developed on contact, of the magnetized material).

The magnets 18 should develop a field across gap 30 sufficient to effectively magnetize the particular material 50. For magnetizing barium ferrite (composite or sintered), the stacked magnets may produce a field (H) of about 8,000 oersteds or more in the gap. (A field of 12,000 oersteds saturates but produces a measured level of magnetization in commercial barium ferrite which is only about 0.5% greater than obtainable with 8,000 oersteds and about 2.0% greater than obtainable with 6,000 oersteds.) The magnetizing magnets preferably should be of a material having a normal coercive force $H_c$ which numerically approaches the value of its residual induction $B_r$. The material should also have a low permeability (high reluctance) as close to 1.0 as possible, like air, preferably no more than about 1.1. Because the highest possible residual induction is preferred, the material should preferably (though not necessarily) be anisotropic in some degree with its preferred direction of magnetization parallel to the longest dimension. The presently preferred material for magnets 18 is the "Incor 28" grade of sintered samarium cobalt made by I.G. Technologies, Inc., which is anisotropic. The magnets should be made and finished to order so that the preferred direction will be parallel to their longest dimension. Such magnets have a residual induction $B_r$ of about 10,500 gauss and a coercive force $H_c$ of about 9,300 oersteds. However it should be understood that magnets of materials other than samarium cobalt (such as magnets of the neodymium-iron class, for example, neodymium-iron boron) can be used with excellent results to magnetize barium ferrite with this apparatus. Less powerful magnets are useful to magnetize some materials other than barium ferrite in the same manner.

The second quadrant permeability of samarium cobalt magnets in the preferred direction of magnetization is about 1.1 times that of air and the stacked magnets therefore provide an approximately 10% better path (less reluctance) for leakage than taken into account by Bozorth, *op. cit.*, for an "ideally" shaped magnet surrounded by air. Further, stacking magnets so that their unlike poles are adjoining causes each magnet to utilize the flux of the other: that is, they draw in the flux through their sides and away from their respective poles, and thus tend to complete their magnetic circuits internally, rather than producing useful external flux at their diametrically opposite poles.

The configuration of the apparatus provides unexpected results. Conventionally, to obtain optimum efficiency, magnet materials having a demagnetization curve approaching unity are most commonly magnetized through the shorter dimension, i.e., through their thickness, as for example taught in the Bouchara '276 patent previously referred to, at col. 2, lines 20–24 and 61–62. In this invention, on the contrary, each magnet is magnetized diametrically, along its long dimension, at a right angle to the most usual direction of magnetization for samarium cobalt and other such permanent magnet materials.

The strip material 50 to be magnetized in gap 30 may be of extended length. (As used hereinafter the term "strip" is intended to include sheet materials as well. By adapting the axial dimension of the magnetizing stacks the apparatus can magnetize wide sheets as well as strips). The material may be either flexible or rigid. The material 50 is magnetized simply by passing it through the air gap 30 between the stacks, at virtually any practicable rate. A strip of material thousands of feet long can easily and quickly be magnetized. Should the material be flexible it may be unwound from a roll as it is fed through the magnetizer, then rewound as it exits.

The stacks 14, 16 should best be spaced apart so that the width of gap 30 is no greater than needed to permit the material 50 to be passed through it without jamming. To accommodate materials of different thickness, the spacing between the stacks is preferably adjustable as by a hand screw 56 which is geared to turn a threaded shaft 58 that is connected to adjustable mounting plate 42. Turning handle 56 raises or lowers the plate and thereby raises or lowers the upper magnet housing 34, relative to the lower housing 36. (Suitable worm gear actuators are commercially available, for example from the Duff-Norton Company.) The adjustable mounting plate 42 is given a range of vertical movement that will permit the housings to be easily removed and other sets installed. Movement of plate 42 is guided and squared by vertical guide posts 44, 46, secured in the frame base 52. Plate 42 is bored to receive sleeve bearings 47 (FIG. 3) to provide the plate with free, non-seizing motion while being guided on posts 44, 46. Stacks 14, 16 can be prevented from abutting and damaging one another by stops 59.

The efficiency achieved with band-like poles is a matter of geometry. In magnetizing material pursuant to the invention the dimensions of the poles formed on the strip (i.e., their center-to-center distance in relation to strip thickness) should be considered in order to insure reasonable magnetic performance of the strip following magnetization. Pole width should, pursuant to practical use, be in the range of about 1–3 times the thickness of the strip, and there should preferably be no unmagnetized space or neutral zone between the poles, that is, adjacent poles should preferably adjoin one another along their boundaries. In other words, the poles should be contiguous on the surface with their parallel edges virtually touching. Narrow poles (and hence the economy of using thin magnetic strips) are desirable in many instances, although pole width and material thickness are often specified by the purchaser. For thin strips and where there is no steel backing on either side of the strip, optimum pole width is in the vicinity of 1.8 times the thickness of the strip. (Use of a steel backing is significantly forgiving of the affect of a poorly selected pole width.) Pole width and the length of the magnetizing stack should be selected as appropriate for the customer's specific application. In relation to a pre-specified pole width, sheet thickness should preferably be in the range from 33% to 100% of the width specified. Both those limits should be kept in mind, the upper and the lower. As a practical matter, if the poles are too narrow in relation to strip thickness, only superficial magnetization may be obtained no matter how intense the magnetizing field, and much of the middle of the strip (i.e., the interior portion between its top and bottom surfaces) will at best be only partially magnetized in the intended direction (parallel to its thickness). This results from the fact that if the strip is too thick, in relation to pole width, the potential difference between unlike poles as seen on one side of a strip will be greater than the potential difference existing between each pole and its respective opposite pole appearing on the other side of the same strip. The unmagnetized portion is in effect wasted material. Some magnetization turning into the plane of the sheet always takes place in the vicinity where the poles appearing on the surface of the sheet are closest, but if the poles are made wide enough in relation to the thickness of the sheet, such magnetization becomes a more negligible percentage of the whole. On the other hand, if the poles are too wide their center to center distance is excessive in relation to the MMF, the value of which is fixed by the thickness of the sheet. The attractive force of the resulting strip at contact is considerably less than it would have been if the width of the poles were within the suggested range. If "reach" is a prime consideration, it can be improved by increasing the pole width, but should also be accompanied by an increase in strip thickness if the level of attraction realized originally on contact is also desired. Use of a steel backing on the strip or sheet contributes much to holding force whatever the pole width and in some degree to reach.

It may seem strange, but the fact is that material 50 will be fully magnetized by the apparatus even if it is moved through the gap virtually as fast as it can be, as by winding equipment. The strip is passed through the gap in the direction of arrow 51 in FIGS. 1 and 2, that is, perpendicularly to the plane defined by the stack axes 32, 32. Magnetization occurs instantly for all practical purposes: the material need not be passed through slowly, or inched or indexed. Moreover, no source of electric current to energize coils is required for magnetization. Tests have established that the magnetizing field level (H oersteds) generated by the stacks does not decrease with use. In this respect the magnetization can be likened to gravity: it doesn't wear out.

Because magnets with band-like poles are widely used for holding purposes, an important measure of their strength is so-called "pull strength." This is the force, in terms of pull per unit area such as ounces per square inch, needed to pull a given magnetic object away from magnetized material with which it is facially engaged. In the data given hereafter pull strength was measured by an Ametek force gauge which is conventionally used to measure the tensile strength of various materials.

COMPARATIVE DATA

A strip of Plastalloy 1A composite barium ferrite material manufactured by the assignee of this application, 0.030" thick, was magnetized by apparatus in accordance with the invention having 18 magnets of samarium cobalt per inch of stack length. Each magnet was 1.5 inches in diameter and 0.055 inches thick (i.e., its dimension in the direction of magnetization was about 50× the strip thickness). The resulting magnetized strips had 18 (0.055" wide) poles per inch of strip width. The pull strength of the magnetized strip material was compared with that of the strongest commercially available, impulse magnetized barium ferrite strip material having band-like poles. The commercial material was 0.030" thick and also had 18 poles per inch.

EXAMPLE 1

No Backing

| Example 1 No backing | |
|---|---|
| Magnetized By Invention | Impulse Magnetized Material |
| Side a, 21.26 ozs./sq. in. | Side a, 19.00 oz./sq. in. |
| Side b, 20.38 ozs./sq. in. | Side b, 9.80 oz./sq. in. |

EXAMPLE 2

0.010" Steel Backing

| Example 2 .010" steel backing | |
|---|---|
| Magnetized By Invention | Impulse Magnetized Material |
| Side a, 24.22 ozs./sq. in. | Side a, 23.97 oz./sq. in. |
| Side b, 24.61 ozs./sq. in. | Side b, 14.56 oz./sq. in. |

Examples 1 and 2 show an improvement in holding power of both sides (a and b) over the impulse magnetized material and an especially remarkable improvement over side b of that material. (Presumably the strip manufacturer placed the impulse magnetizing fixture on only one side of the strip, as is often practiced to reduce maintenance and to avoid overloading power lines during demanding production runs.) Indeed, the apparatus of this invention achieves results which equal or exceed those obtained by an impulse magnetizer. And, while the apparatus specifically described has 18 poles per inch of width, it should be realized that more or fewer poles per inch can be used to suit specific applications.

In other tests, the same type and thickness of strip material was magnetized in apparatus having magnetizing stacks with 11 poles per inch (11 magnets each 0.09" wide), each 1.5 inches long (i.e., a magnetic length of about 50× strip thickness). It is compared with commercially available impulse magnetized material of the same thickness, also having 11 poles per inch of width.

EXAMPLE 3

No Backing

| Example 3 No backing | |
|---|---|
| Magnetized By Invention | Impulse Magnetized Material |
| Side a, 16.96 ozs./sq. in. | Side a, 13.90 ozs./sq. in. |
| Side b, 16.93 ozs./sq. in. | Side b, 7.20 ozs./sq. in. |

EXAMPLE 4

0.010" Steel Backing

| Example 4 .010" steel backing | |
|---|---|
| Magnetized By Invention | Impulse Magnetized Material |
| Side a, 28.10 ozs./sq. in. | Side a, 21.50 ozs./sq. in. |
| Side b, 27.34 ozs./sq. in. | Side b, 13.97 ozs./sq. in. |

Again it is apparent that the material magnetized by the present apparatus and process is higher in strength than the commercial material on both side a and side b. However, the strengths of sides a and b in Examples 3 and 4 are less than those in Examples 1 and 2. The decrease stems from the greater pole width, which is almost too wide in relation to the 0.030" strip thickness, considering the range previously described. A comparison of Example 3 with Example 4 shows how effective steel backing can be. The backing produces an increase of 11 additional ounces of pull for strip magnetized by the method of the invention, and 8 ounces for the commercial material.

EXAMPLE 5

Figure 10:
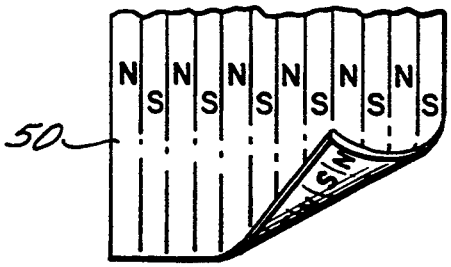
FIG. 10 is an enlarged perspective view of a strip magnetized by the apparatus, diagrammatically showing the band-like poles on both its surfaces.

This example shows the reduction in holding power resulting from the presence of a neutral zone between band-like poles on a magnetized strip. Electrical apparatus having the "polar step" (pole width plus neutral zone width) shown in Example 3 of Bouchara U.S. Pat. No. 4,379,276 was constructed. The poles were 6.25 mm. (0.25") wide and the neutral zone 4 mm. wide (0.156"), making a polar stept of 10.25 mm (0.4"). That apparatus was used to magnetize a strip of Plastalloy 1A, 2 mm (0.078") thick, to saturation. The attractive force of both sides of the strip measured substantially the same, about 9.5 oz. per sq. inch. Viewing the strip with a transparent plastic sheet containing a suspension of iron oxide particles and sold under the mark "Magnerite," manufactured by Eurand America, Inc., Dayton, Ohio, indicated non-magnetized paths about 0.16" wide running between and parallel to 0.25" band-like poles. The non-magnetized portions totaled about 40% of the total width of the strip, as seen in FIG. 10 of the Bouchara patent and discussed in Example 3 of that patent.

In contrast, when the same material was magnetized with a saturating field, to form adjoining band-like poles 0.25" wide (i.e., with no neutral zone between them), the material had a much higher pull strength, 20.27 oz. per square inch on the best side and a pull strength within a fraction of that on the opposite side of the strip.

In the embodiment described above the stacks 14, 16 are of circular, plate-like magnets 18 stacked in facial engagement with one another. As previously noted, magnets of other shapes can be used, as for example long right cylindrical magnets 19 as shown in FIG. 8, arranged in side by side line contact with one another and housed in a slot-like cavity 70. These magnets 19 are elongated, that is, longer in the direction of magnetization than in their thickness, and their longitudinal axes are aligned colinearly with the longitudinal axes of the corresponding magnets arrayed on the opposite side of the air gap (see FIG. 8), and with the north and south poles alternating vectorially from one adjacent magnet to the next. It is useful to provide a tapered end 66 on each elongated magnet, at the end thereof at air gap 60. The tapered end seats between inwardly tapering lower side walls 68, 68 of the cavity 70, and a portion of the magnet tip extends beyond the taper. The tapered side walls 68, 68 support the magnets and prevent the tapered ends 66 of the magnets (the pole width) from rotating out of place. This, however, is by way of example only and other means for holding the magnets in position may be used.

Figure 11:
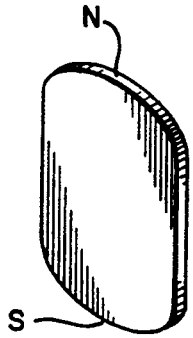
FIG. 11 is a perspective view of another form of individual magnet for use in accordance with the invention.
Figure 12A:
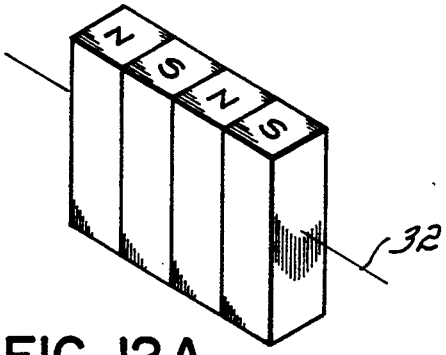
FIGS. 12A, B, C, and D are a series of perspective views showing individual stacks of magnets of other shapes useful in the apparatus of this invention. Specifically.
Figure 12B:
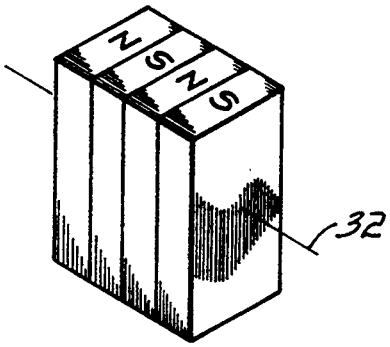
FIG. 12B shows a stack of thin rectangular plates in side-by-side coplanar contact.
Figure 12C:
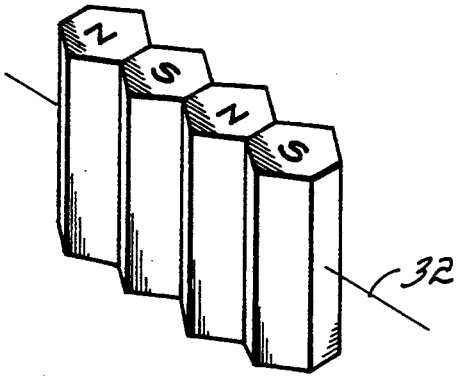
FIG. 12C shows a straight stack of hexagonal sectioned bars placed in side-by-side coplanar contact.
Figure 12D:
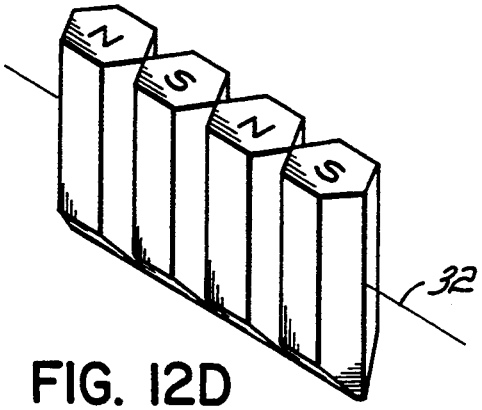
FIG. 12D shows a stack of hexagonal sectioned bars placed in edge-to-edge contact.

Other useful magnet shapes include but are not limited to elongated square sectioned bar magnets (FIG. 12A); rectangular sectioned plates (FIG. 12B); and a host of other shapes including for example hexagonal sectioned bars (FIGS. 12C and 12D). All are magnetized along their long axes, and perpendicular to the axes of rotation 32 of the stacks, i.e., perpendicular to axes paralleling the direction of stacking. The width of the magnet need not but may be greater than its thickness. Adjacent magnets should be in facial engagement along their sides (FIGS. 12A, 12B, and 12C), or along their edges (FIG. 12D). The presently preferred magnet shapes are the circular plate-like magnets 18 of FIG. 4 and the rectangular plates of FIGS. 11 and 12B. If the magnets extend beyond the cavity and have chamfered (tapered) edges, the slot should be correspondingly tapered, as already explained in relation to FIG. 8. In FIG. 12D the magnets in the stack are shown as being tapered and rounded at the end which will be adjacent the air gap. The sharp edge formed by a chamfer should be rounded to prevent gouging or excessive interference with the travel of the material to be magnetized.

If it is difficult or commercially impractical to obtain magnets in a desired length, magnets such as those shown for example in FIGS. 8 and 12A-D can be elongated to a desired length by placing shorter magnets one on top of another. Such an assemblage of shorter magnets would perform like a single, integral longer magnet in accordance with the invention.

Having described the invention, what is claimed is:

1. Apparatus for magnetizing strip or sheet form permanent magnet material, comprising two parallel stacks of permanent magnets, each stack having an axis which is parallel to the direction of stacking, said stacks presenting a slot-like air gap between them through which permanent magnetic material to be magnetized can be passed in a direction perpendicular to a plane containing both said axes of said stacks, each magnet in each stack having two opposite ends and a direction of magnetization extending to form a pole on one of said ends and an unlike pole on the other of said ends, said direction of magnetization being perpendicular to said axes of said stacks and lying in said plane containing said axes, adjacent magnets in each stack having unlike poles proximate one another so that they magnetically attract, the magnets of one stack being opposite the respective magnets of the other stack, poles of the magnets of one stack being positioned across said gap from unlike poles of the respective magnets of the other stack, a frame holding said stacks in such relation, each magnet having a magnetic length dimension between said ends which is greater than its dimension parallel to said axes and which establishes a magnetizing field in said gap to effectively magnetize permanent magnet material of the barium ferrite class within said gap, said apparatus thereby being adapted to simultaneously form adjacent north and south poles on said permanent magnet material when placed within said gap.

2. The apparatus of claim 1 wherein said magnets are in the form of cylinders, bars or plates, having longitudinal axes and are magnetized parallel to said longitudinal axes.

3. The apparatus of claim 1 wherein said magnets have parallel faces and are magnetized parallel to said faces, faces of adjacent magnets in said stacks being substantially in facial engagement.

4. The apparatus of claim 1 wherein the width of said poles on said ends of said magnets is at least equal to the thickness of said material to be magnetized.

5. Apparatus for magnetizing strip or sheet form permanent magnet material, comprising two stacks of permanent magnets, each stack having an axis in the direction of stacking, said axes being parallel; each magnet being in the form of a plate or bar and having a direction of magnetization which is perpendicular to said axes and which is in a plane defined by the two said axes of said stacks, each magnet having poles on diametrically opposite ends thereof, adjacent magnets in the stacks being substantially in engagement with one another and having unlike poles proximate one another so that they magnetically attract, a frame positioning said stacks with a slot-like air gap between them, said apparatus permitting said permanent magnet material to be passed through said gap in a direction of movement perpendicular to said plane defined by said axes of said stacks, the magnets of one stack being opposite the respective magnets of the other stack, the poles of the magnets of one stack being positioned across said gap from unlike poles of the respective magnets of the other stack, said stacks being so close together that magnetic flux from the unlike poles of magnets on opposite sides of said air gap establishes a magnetizing field in said gap to effectively magnetize a desired permanent magnet material, whereby band-like poles can simultaneously be formed across said material by passing it through said gap in said direction of movement.

6. The apparatus of claim 5 wherein adjacent magnets in each stack have sides which are in facial engagement.

7. The apparatus of claim 5 wherein adjacent magnets in each stack have sides which are in edge-to-edge contact.

8. The apparatus of claim 5 in which the total magnetic length of corresponding magnets on opposite sides of the air gap is in the range of about 6 to 100 times the thickness of the permanent magnet material which is to be magnetized by passing through said air gap.

9. The apparatus of claim 5 wherein the sides of the magnets in each stack are engaged with sides of adjacent magnets in the same stack, with no spacer between them.

10. The apparatus of claim 5 wherein all said magnets are of substantially the same size and shape.

11. The apparatus of claim 5 wherein the sides of the magnets of the respective stacks define planes which are substantially coplanar with one another.

12. The apparatus of claim 5 in which said magnets are of a permanent magnet material having a residual induction ($B_r$) of at least about 10,000 gauss.

13. The apparatus of claim 5 wherein each magnet is of an anisotropic magnet material having a preferred direction of magnetization in a direction parallel to said sides.

14. The apparatus of claim 5 in which said magnets are of permanent magnet material having a permeability of about 1.1.

15. The apparatus of claim 5 in which said magnets are of the samarium cobalt class.

16. The apparatus of claim 5 in which said magnets are of the neodymium iron class.

17. The apparatus of claim 5 wherein said frame is of non-magnetic material.

18. The apparatus of claim 1 wherein said magnets have magnetic lengths which are at least three times the separation between said stacks.

19. The apparatus of claim 5, further wherein said direction of magnetization of each magnet is perpendicular to the said ends of that magnet.

20. Apparatus for magnetizing strip or sheet form permanent magnet material, comprising two parallel stacks of permanent magnets, each magnet being in the form of a plate or bar having parallel sides, each magnet being of a material having a demagnetization curve with a slope approaching unity, and being magnetized in the direction of its longest dimension and having a direction of magnetization which is parallel to said sides and which is in a plane defined by axes of said stacks in the direction of stacking, each magnet having poles on diametrically opposite ends thereof, adjacent magnets in the stacks being substantially in engagement with one another and having unlike poles proximate one another so that they magnetically attract, a frame positioning said stacks with a slot-like air gap between them, through which gap said permanent magnetic material can be passed in a direction perpendicular to said plane defined by said axes of said stacks, to be magnetized, the magnets of one stack being opposite the respective magnets of the other stack, the poles of the magnets of one stack being positioned across said gap from unlike poles of the respective magnets of the other stack, said stacks being so close together that magnetic flux from the unlike poles of magnets on opposite sides of said air gap establishes a magnetizing field in said gap to effectively magnetize a desired permanent magnet material when passed through said gap.

21. Apparatus for magnetizing strip or sheet form permanent magnet material, comprising two parallel stacks of permanent magnets, each said stack having an axis which is parallel to a direction of stacking, each said magnet being a short right cylinder having parallel faces, each magnet of said stacks having a direction of magnetization which is parallel to said faces and which is in a plane defined by said axes of said stacks, each said magnet having a central axis parallel to said air gap, each magnet having poles on diametrically opposite ends thereof, adjacent magnets in the stacks having unlike poles proximate one another so that they magnetically attract, a frame positioning said stacks with a slot-like air gap between them, through which gap said permanent magnetic material can be passed to be magnetized, the magnets of one stack being opposite the respective magnets of the other stack, the poles of the magnets of one stack being positioned across said gap from unlike poles of respective magnets of the other stack, magnetic flux between the unlike poles of magnets on opposite sides of said air gap establishing a magnetizing field in said gap.

22. Apparatus for magnetizing strip or sheet form permanent magnet material, comprising two parallel stacks of permanent magnets, each magnet being in the form of a plate or bar having parallel sides, each magnet of said stacks having a direction of magnetization which is parallel to said sides and which is in a plane defined by axes of said stacks in the direction of stacking, each magnet having poles on diametrically opposite ends thereof, adjacent magnets in the stacks being substantially in engagement with one another and having unlike poles proximate one another so that they magnetically attract, a frame positioning said stacks with a slot-like air gap between them, through which gap said permanent magnetic material can be passed in a direction perpendicular to said plane defined by said axes of said stacks to be magnetized, said frame further comprising a pair of non-magnetic holders, each holder having a cavity in which a said stack is received, said frame holding said holders apart from one another to present an air gap between them, the magnets of one stack being opposite the respective magnets of the other stack, the poles of the magnets of one stack being positioned across said gap from unlike poles of the respective magnets of the other stack, said stacks being so close together that magnetic flux from the unlike poles of magnets on opposite sides of said air gap establishes a magnetizing field in said gap to effectively magnetize a desired permanent magnetic material when passed through said gap.

23. The apparatus of claim 22 wherein said holders are removable from said frame and other holders can be inserted in place thereof to hold different magnet stacks in alignment with each other.

24. Apparatus for magnetizing strip or sheet form permanent magnet material, comprising two parallel stacks of permanent magnets, each magnet being in the form of a plate or bar having parallel sides, each magnet of said stacks having a direction of magnetization which is parallel to said sides and which is in a plane defined by axes of said stacks in the direction of stacking, each magnet having poles on diametrically opposite ends thereof, adjacent magnets in the stacks having unlike poles proximate one another so that they magnetically attract, a frame positioning said stacks with a slot-like air gap between them, through which gap said permanent magnet material can be passed to be magnetized, the magnets of one stack being opposite the respective magnets of the other stack, the poles of the magnets of one stack being positioned across said gap from unlike poles of the respective magnets of the other stack, said frame comprising a pair of non-magnetic holders, each holder having a seat in which said stack is received, said frame holding said holders apart from one another to present an air gap between said stacks, and means for adjusting the spacing between said holders in said frame, thereby to change the height of said air gap.

25. The apparatus of claim 24 wherein one of said stacks is adjustably mounted for movement in a direction to change the separation of the stacks.

26. The process of magnetizing band-like poles on strip or sheet form permanent magnet material without use of an electromagnetic field, comprising providing two parallel stacks of permanent magnets, each stack having an axis, the magnets of each stack having a direction of magnetization which is mutually perpendicular to the axis of the other stack, each said axis being parallel to the direction of stacking, adjacent magnets in each stack being placed with unlike poles adjoining so that they magnetically attract one another, positioning and securing said stacks parallel to one another with a slot-like gap between them, the magnets of one stack being positioned opposite the respective magnets of the other stack with unlike poles of corresponding magnets of the stacks being adjacent one another across said gap, said magnets having magnetic lengths which are so great in relation to the height of said gap that they establish a field in said gap to effectively magnetize permanent magnet material placed in said gap, and passing said permanent magnet material through said gap, perpendicularly to a plane containing said axes of said stacks, thereby forming band-like poles on the said material.

27. The process of claim 26 wherein said strip is magnetized by passing it through said air gap without indexing it.

28. The process of claim 26 wherein said magnets have a magnetic length which is 3–50 times the thickness of said permanent magnet material.

29. The process of claim 26 wherein the width of said band-like poles is about 1–3 times the thickness of said permanent magnet material being magnetized.

30. The process of claim 26 wherein said permanent magnets are of the rare earth class of permanent magnet materials.

31. The process of claim 26 wherein said strip or sheet form permanent magnet material is barium ferrite.

32. The process of claim 26 wherein said stacks are assembled of magnets, each said magnet having a thickness approximately equal to a desired width of said band-like poles to be formed on said permanent magnet material.

33. The process of claim 26 including the further step of providing a magnetic shunt across the poles of the magnets of at least one said stack, opposite from said gap.

34. The process of magnetizing band-like poles on strip or sheet form permanent magnet material without use of an electromagnetic field, comprising providing two parallel stacks of permanent magnets, each stack having an axis, the magnets of each stack having a direction of magnetization which is mutually perpendicular to the axis of the other stack, each said axis being parallel to the direction of stacking, adjacent magnets in each stack being placed with unlike poles adjoining so that they magnetically attract one another, said magnets being placed in engagement with one another, with no spacers between them, positioning said stacks parallel to one another with a slot-like gap between them, the magnets of one stack being positioned opposite the respective magnets of the other stack with unlike poles of corresponding magnets of the stacks being adjacent one another across said gap, and passing said magnet material through said gap, perpendicularly to a plane containing the axes of said stacks, thereby forming band-like poles on the said material.

35. The process of claim 34 wherein said magnets are in facial engagement with one another.

36. The process of claim 34 wherein said magnets are placed in edge engagement with one another.

37. The process of magnetizing band-like poles on strip or sheet form permanent magnet material comprising, providing two parallel stacks of permanent magnets, the magnets of each stack having a direction of magnetization which is mutually perpendicular to the axis of the other stack, each said axis being parallel to the direction of stacking, adjacent magnets in each stack being placed with unlike poles adjoining so that they magnetically attract one another, positioning said stacks parallel to one another with a slot-like gap between them, the magnets of one stack being positioned opposite the respective magnets of the other stack with unlike poles of corresponding magnets of the stacks being adjacent one another across said gap, and passing said magnet material through said gap, perpendicularly to a plane containing axes in the direction of stacking of the stacks, thereby forming band-like poles on the said material which poles adjoin one another, with no unmagnetized space between them.

38. Apparatus for magnetizing strip or sheet form permanent magnet material without the use of an electromagnetic field, comprising two stacks of permanent magnets, each said stack having an axis in the direction of stacking which is parallel to that of the other stack, said stacks presenting a slot-like air gap between them through which permanent magnetic material can be passed in a direction perpendicular to a plane containing said axes of said stacks, to be magnetized, each magnet in each stack having two diametrically opposite ends and a direction of magnetization which extends to form a pole on one said end and an unlike pole on the other said end, the magnetic length of each magnet being perpendicular to said axis of each said stack and greater than the dimension of the magnet in the direction parallel to said axis, adjacent magnets in each stack having unlike poles proximate one another so that they magnetically attract, the magnets of one stack being opposite the respective magnets of the other stack, poles of the magnets of one stack being positioned across said gap from unlike poles of the respective magnets of the other stack, a frame holding said stacks in such relation, magnetic flux between unlike poles of magnets on opposite sides of said gap establishing a magnetizing field in said gap for effectively magnetizing permanent magnet material, passed through said gap, with adjacent north and south band-like poles.

39. The apparatus of claim 38 in which the magnetic length of each magnet is in the range of about 3 to 50 times the thickness of the permanent magnet material which is to be magnetized by passing through said air gap.

40. The apparatus of claim 38 wherein said magnets are elongated and have diametrically opposite ends with said poles on said ends.

41. Apparatus for magnetizing strip or sheet form permanent magnet material, comprising two parallel stacks of permanent magnets, each said stack having a stacking axis in the direction of stacking, each said magnet being an elongated bar having parallel sides and a direction of magnetization parallel to said sides and in a plane defined by said stacking axes of said stacks, each said magnet having a central axis which is perpendicular to the stacking axis of its stack, each magnet having poles on diametrically opposite ends thereof, adjacent magnets in the stacks having unlike poles proximate one another so that they magnetically attract, a frame positioning said stacks with a slot-like air gap between them such that said permanent magnet material can be passed through said gap in a direction perpendicular to a plane containing said stacking axes, thereby to be magnetized, the magnets of one stack being opposite the respective magnets of the other stack, the poles of the magnets of one stack being positioned across said gap from unlike poles of respective magnets of the other stack, magnetic flux between the unlike poles of magnets on opposite sides of said air gap establishing a magnetizing field in said gap, said apparatus in use simultaneously forming band-like poles across strip or sheet form permanent magnet material as it is passed through said gap in said direction perpendicular to said plane containing both said stacking axes.

* * * * *